US009568260B2

(12) United States Patent
Stone et al.

(10) Patent No.: US 9,568,260 B2
(45) Date of Patent: Feb. 14, 2017

(54) HEAT EXCHANGER BLOWER METHOD

(71) Applicant: Horton, Inc., Roseville, MN (US)

(72) Inventors: Stephen Anthony Stone, Richfield, MN (US); Michael J. Campbell, Bloomington, MN (US); Jamil Marwan Orfali, Woodbury, MN (US); Jacob Vincent VandeHei, Green Bay, WI (US); Kevin Watson, Champlin, MN (US); Thomas Schmidt, Eden Prairie, MN (US); David R. Hennessy, Burnsville, MN (US); Neal Shawaluk, Lino Lakes, MN (US)

(73) Assignee: Horton, Inc., Roseville, MN (US)

( * ) Notice: Subject to any disclaimer, the term of this patent is extended or adjusted under 35 U.S.C. 154(b) by 71 days.

(21) Appl. No.: 14/533,775

(22) Filed: Nov. 5, 2014

(65) Prior Publication Data

US 2015/0153122 A1 Jun. 4, 2015

Related U.S. Application Data

(63) Continuation-in-part of application No. 13/462,482, filed on May 2, 2012, now Pat. No. 9,334,788.

(60) Provisional application No. 61/481,587, filed on May 2, 2011.

(51) Int. Cl.

| | |
|---|---|
| ***F28G 1/16*** | (2006.01) |
| ***F28G 3/16*** | (2006.01) |
| ***F01P 11/06*** | (2006.01) |
| ***F28G 15/02*** | (2006.01) |

(52) U.S. Cl.

CPC ..... *F28G 3/166* (2013.01); *F01P 11/06* (2013.01); *F28G 1/166* (2013.01); *F28G 15/02* (2013.01); *F01P 2011/063* (2013.01)

(58) Field of Classification Search

CPC ..... F28G 1/166

See application file for complete search history.

(56) References Cited

U.S. PATENT DOCUMENTS

| | | | |
|---|---|---|---|
| 1,903,650 | A | 4/1933 | Snow et al. |
| 3,771,893 | A | 11/1973 | Miller |
| 4,332,292 | A | 6/1982 | Garberick |
| 4,666,531 | A | 5/1987 | Minard |
| 4,771,822 | A | 9/1988 | Barbosa |

(Continued)

FOREIGN PATENT DOCUMENTS

| | | |
|---|---|---|
| CA | 1 132 410 | 9/1982 |
| GB | 1 524 580 | 9/1978 |

(Continued)

*Primary Examiner* — Jason Ko

(74) *Attorney, Agent, or Firm* — Westman, Champlin & Koehler, P.A.

(57) ABSTRACT

A cleaning system for use with a heat exchanger and a fluid pressurizing assembly includes a wand assembly, a pivot assembly, and a movement mechanism having a body and a piston rod moveable relative the body in response to fluid pressurization. The wand assembly includes a wand in fluid communication with the fluid pressurizing assembly, and having a first orifice configured to eject fluid toward the heat exchanger. The wand is supported by the pivot assembly such that the wand is selectively pivotable about a first pivot axis. The movement mechanism connects to the pivot assembly at a second pivot axis offset from the first pivot axis such that selective movement of the piston rod produces pivotal movement of the wand about the pivot axis.

28 Claims, 14 Drawing Sheets

(56) References Cited

U.S. PATENT DOCUMENTS

| | | | |
|---|---|---|---|
| 5,279,357 | A | 1/1994 | Kennon et al. |
| 5,285,802 | A | 2/1994 | Soderquist |
| 5,879,466 | A | 3/1999 | Creger et al. |
| 6,190,126 | B1 | 2/2001 | Haegele et al. |
| 6,217,638 | B1 | 4/2001 | Van de Velde |
| 6,318,108 | B1 | 11/2001 | Holstein et al. |
| 6,942,458 | B2 | 9/2005 | McCallum et al. |
| 7,418,997 | B2 | 9/2008 | Martin et al. |
| 7,459,870 | B2 | 12/2008 | Beck et al. |
| 2006/0283157 | A1 | 12/2006 | Keys, II et al. |
| 2008/0120802 | A1 | 5/2008 | Harvey |
| 2012/0048513 | A1 | 3/2012 | Crum |

FOREIGN PATENT DOCUMENTS

| | | | |
|---|---|---|---|
| JP | 2003314284 | A | 11/2003 |
| SU | 651188 | A1 | 3/1979 |

HEAT EXCHANGER BLOWER METHOD

CROSS-REFERENCE TO RELATED APPLICATION(S)

This application is a continuation-in-part to U.S. patent application Ser. No. 13/462,482 entitled "Heat Exchanger Blower System and Associated Method", filed May 2, 2012, which claims priority to U.S. Provisional Patent Application Ser. No. 61/481,587 entitled "Heat Exchanger Blower," filed May 2, 2011, both of which are hereby incorporated by reference in their entirety.

BACKGROUND

The present invention relates to powered equipment having a heat exchanger, and more particularly to an apparatus and method for reducing heat exchanger clogging and debris accumulation.

Vehicles and equipment with internal combustion engines typically include a heat exchanger (e.g., radiator) that helps shed heat. In many applications, such as agricultural and off-road settings, debris may be present that can accumulate on and clog the heat exchanger. Debris can include caked dirt, trash, chaff, etc. Clogging and other accumulation is a particular problem because of fans that draw air through the exchanger to facilitate cooling, which can draw in debris incidental to the desired airflow. Equipment can potentially over-heat due to debris blocking the airflow over the equipment's heat exchanger packages. Clogged heat exchangers cannot reject heat as proficiently as clean heat exchangers due to a lower amount of total clean fin surface area. For example, heat exchanger clogging problems have multiplied in recent years as agricultural vehicles have increased in complexity and power output, without increasing heat exchanger size. This has necessitated heat exchangers to become more efficient while retaining the same exterior dimensions, causing fin density to increase, which means smaller passages between fins. Greater fin density only intensifies the rate at which dirt and debris will become clogged in the heat exchanger, requiring the vehicle operator to clean the heat exchanger much more frequently.

There is limited technology in existence used to clean a clogged heat exchanger, and existing solutions have numerous problems from long equipment down-times to high costs. Operators can manually remove debris, such as manually using compressed air hoses and an air compressor, but such efforts are burdensome and may be difficult to perform in the field. Manual cleaning carries undesirably high equipment down-times. Prior art approaches have included reversing cooling fan airflow in order to blow air out of the engine compartment through the exchanger to dislodge debris and reduce clogging. This approach, however, may be inadequate where an available fan cannot generate a reverse airflow. For instance, certain fan designs (e.g., hybrid flow fans) may be able to generate an intake airflow when rotated in one direction, but do not generate much of a reverse airflow when rotated in the opposite direction. Mechanisms to change the direction of fan rotation also add complexity and cost to the system. Furthermore, reversible pitch fans that can reverse airflow while rotating in the same direction tend to be expensive and require complex pitch actuation systems. Another problem is that altering the appearance of an exterior of a vehicle or other piece of equipment may be considered aesthetically displeasing to customers, who may forego a heat exchanger cleaning system that has an unattractive appearance from an exterior viewpoint.

SUMMARY

In one aspect of the present invention, a cleaning system for use with a heat exchanger and a fluid pressurizing assembly includes a wand assembly, a pivot assembly, and a movement mechanism having a body and a piston rod moveable relative the body in response to fluid pressurization. The wand assembly includes a wand in fluid communication with the fluid pressurizing assembly, and having a first orifice configured to eject fluid toward the heat exchanger. The wand is supported by the pivot assembly such that the wand is selectively pivotable about a first pivot axis. The movement mechanism connects to the pivot assembly at a second pivot axis offset from the first pivot axis such that selective movement of the piston rod produces pivotal movement of the wand about the pivot axis.

The present summary is provided only by way of example, and not limitation. Other aspects of the present disclosure will be appreciated in view of the entirety of the present disclosure, including the entire text, claims and accompanying figures.

Figure 1A:
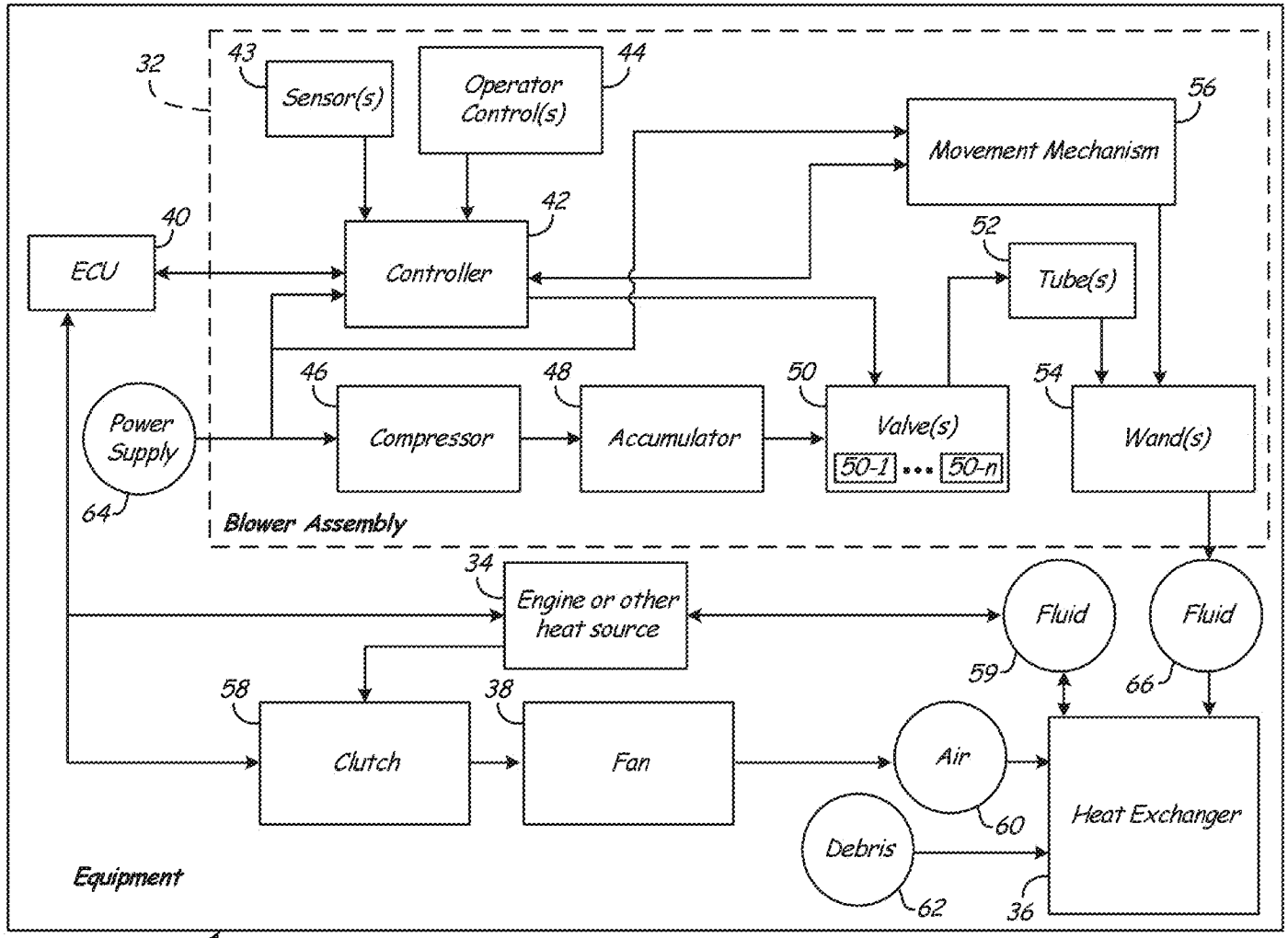
FIG. 1A is a schematic block diagram of an equipment system 30 that includes a heat exchanger blower assembly according to the present invention.

While the above-identified drawing figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

In general, the present invention utilizes fluid blown (i.e., directed under pressure or force) at a backside of a radiator that may be clogged or otherwise have debris accumulation. It has been discovered experimentally by the inventors that reducing flow through a heat exchanger by as little as 6.8% with fine-grade dust produces a thoroughly fouled heat exchanger with significantly reduced performance. The fluid can be selectively blown at the heat exchanger in discrete "blasts" governed by a controller, according to the present invention. The fluid can be compressed air, or could be another gas or a liquid (e.g., water) in alternative embodiments. This fluid can be blown through holes in one or more wands (or pipes), which can be pivotally attached to a peripheral corner of the heat exchanger and configured to sweep across a portion (e.g., majority) of the heat exchanger surface area. Any number of wands can be used, as desired for particular applications, and each wand can have one or more orifices to exhaust fluid toward the heat exchanger. In one embodiment, two wands can be provided in a parallel or other adjacent configuration, with each wand having a plurality of fluid outlet openings. The wands can be positioned at a rear side of the heat exchanger, between the heat exchanger and a fan, so as to output fluid in an opposite direction as ambient or fan-driven airflow during normal heat exchanger operation. In alternative embodiments, the pipes or wands could be mounted at other locations, such as at or near any suitable portion of a perimeter of the heat exchanger. The wands can be mounted on a support block with several clamps, which can be attached to a shaft driven by a gear motor (e.g., electric motor). The wands can be commonly supported by the support block to allow simultaneous and synchronous pivoting of multiple wands. This assembly can be held in place by a mounting block (e.g., made of aluminum) mounted to a side of the heat exchanger, with bearings to hold the shaft while allowing it to rotate. Alternatively, the wands can be actuated by any suitable mechanism, such as with fluidic (e.g., pneumatic, hydraulic) actuation, and can alternatively have non-pivotal (e.g., translational) configurations.

In another aspect of the present invention, particular fluid flow parameters are provided that can help achieve relatively good performance for heat exchanger cleaning with a relatively low risk of damage to heat exchanger fins. Periodic cleanings at relatively lower fluid pressures can help maintain a clean and clear heat exchanger without the need to employ relatively high pressure fluid flows to clean a highly fouled heat exchanger, at which time high fluid pressure present a greater risk of heat exchanger damage. The fluid flow parameters of the present invention are usable with nearly any type of wand configuration, whether pivoting, translational, etc. and/or with circular fluid outlets, air knife slots, etc.

Various features and benefits of the present invention will be further appreciated in view of the description that follows and the accompanying drawings.

FIG. 1A is a schematic block diagram of an equipment system 30 (e.g., vehicle, agricultural/industrial machine, etc.) that includes a heat exchanger blower assembly 32, an engine (or other heat source) 34, a heat exchanger 36 (e.g., radiator), a fan 38, and an engine control unit (ECU) 40. The blower assembly 32 includes a controller 42, one or more sensors 43, one or more operator controls 44, a compressor 46, an accumulator 48, one or more valves 50 (individually identified as 50-1 to **50-*n*), one or more tubes or conduits 52, one or more wands 54, and a movement mechanism 56**.

The engine 34 can be an internal combustion engine, or any other type of heat producing source, such as an electric motor or air conditioning compressor. The heat exchanger 36 is connected to the engine 34 to provide heat rejection, for instance, accepting hot fluid from the engine 34 and returning cooler fluid to the engine 34 on a fluidic circuit. The engine 34 can be connected to and governed at least in part by the ECU 40. The fan 38 can be driven by torque produced by the engine 34. In some embodiments, a clutch 58 can optionally be provided to selectively control rotation of the fan 38. The clutch 58 can be of a known configuration, and can be controlled via the ECU 40.

The heat exchanger 36 (e.g., radiator) can be of a conventional configuration with at least one conduit forming a generally circuitous path for a fluid 59 (e.g., a liquid thermal medium), and fins extending to or from the conduits to provide a relatively large surface area to transfer thermal energy from the fluid 59 in the conduit to air 60. In a typical heat exchanger 36 for a vehicle or agricultural equipment, the fins can be relatively densely packed, with relatively small inter-fin passages for flow of the air 60. Dense heat exchanger design tends to be driven by relatively high heat rejection requirements combined with relatively limited space envelopes (i.e., volumes) available for the heat exchanger package. Such dense heat exchangers may be sensitive to clogging/fouling. Clogged heat exchangers cannot reject heat as proficiently as clean heat exchangers due to a lower amount of total clean fin surface area. It is further noted that the fins of the heat exchanger 36 can be relatively fragile, such that forces applied to those fins may bend or otherwise deform or damage them. The bending of fins on the heat exchanger 36 can reduce air flow and thereby reduce efficiency of the heat exchanger 36.

The fan 38 can be rotated to move ambient air 60 through or past the heat exchanger 36, as well as toward or past the engine 34. In one embodiment, the fan 38 is an axial flow fan of any suitable configuration. In another embodiment, the fan 38 is a hybrid or mixed-flow fan, such as that disclosed in commonly assigned U.S. Pat. App. Pub. No. 2010/0329871 entitled HYBRID FLOW FAN APPARATUS. As the fan 38 operates, debris 62 entrained in the air 60 or otherwise present through splatter, etc. may come into contact with the heat exchanger 36. The debris 62 can include dust, dirt, liquids and slurries, agricultural material (e.g., chaff), large or small particles, trash, or nearly any other type of object or material. Debris 62 may accumulate on surfaces of the heat exchanger 36, leading to fouling, that is, clogging that reduces or blocks the flow of the air 60 in regions of the heat exchanger 36 where the debris 62 collects or that otherwise reduces heat transfer from surfaces of the heat exchanger 36 to the air 60 (e.g., through an undesired insulating effect).

In the illustrated embodiment, the blower assembly 32 includes the compressor 46 for pressurizing a fluid 66, such as air, water or a cleaning solution, which can be provided to the accumulator 48. The accumulator 48 can be a pressurized tank for storing pressurized fluid and acting as a buffer to uneven or intermittent use of the pressurized fluid over time, though at least a portion of fluid from the compressor 46 can bypass the accumulator 48. A power supply 64 (e.g., battery, generator, etc.) can supply power to operate the compressor 46, which can be electrically operated. In an alternative embodiment, the compressor can be mechanically powered by the engine 34. In further embodiments, the compressor 46 could be an existing pressurized fluid system of the equipment system 30 that merely provides some pressurized fluid to the accumulator 48, meaning no separate compressor 46 is required.

One or more valves 50 can be positioned downstream of the accumulator 48 to control flow of the pressurized fluid from the compressor 46. In one embodiment, the valve(s) 50 are solenoid valves, powered by the power supply 64 and governed by the controller 42. The number of valves 50 can vary as desired for particular applications. In some embodiments, a single valve 50 can control fluid flow to multiple downstream elements through a suitable manifold, or can be dedicated to a single downstream element.

The controller 42 can be connected to the compressor 46 to govern operation of the compressor 46, such as to activate and deactivate compressor cycling, etc. In addition, the controller 42 can govern operation of the valve(s) 50 to control fluid flow from the accumulator 48 or compressor 46. The controller 42 can operate the blower assembly 32 on a schedule, in response to feedback from appropriate sensors 43, and/or in response to operator commands. The operator control(s) 44 can provide suitable input mechanisms (e.g., buttons, levers, switches, dials, etc.) to allow an operator to selectively activate the blower assembly 32, and/or to shut off the assembly 32, such as in the form of one or more kill switches. In the illustrated embodiment, the controller 42 is dedicated to the blower assembly 32, and can interface with the ECU 40 for the entire equipment system 30. However, in alternative embodiments, the controller 42 can be integrated within the ECU 40.

One or more wands 54 are connected downstream of the valve(s) 50 by the tube(s) 52. The wands 54 are configured to deliver the fluid 66 at or through the heat exchanger 36. The tube(s) 52 can be flexible tubing capable of containing pressurized fluid, or other types of conduits. The wand(s) 54 can be movable relative to the heat exchanger 36, such as in a pivoting or translational movement. The movement mechanism 56 is engaged with the wand(s) 54 to produce desired wand movement. The controller 42 can govern operation of the movement mechanism 56. In the illustrated embodiment, the movement mechanism 56 includes an electric motor powered by the power supply 64.

Figure 1B:
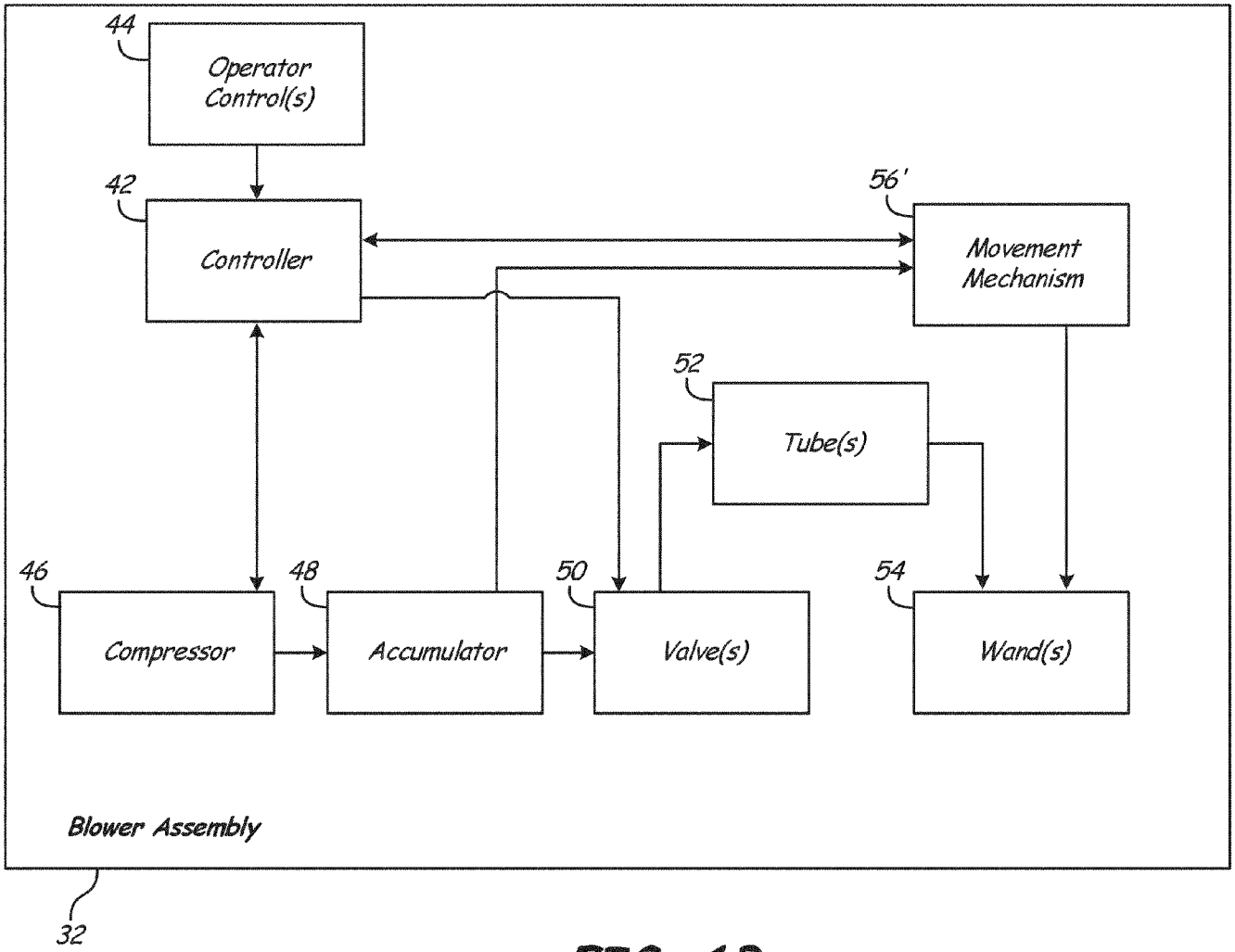
FIG. 1B is a schematic of an alternate embodiment of the heat exchange blower assembly of FIG. 1A.

In an alternative embodiment shown in FIG. 1B, the heat exchanger blower assembly 32 can utilize a fluidically powered (e.g., pneumatic or hydraulic) movement mechanism 56'. As shown in FIG. 1B, fluid from the compressor 46 and the accumulator 48 is directed to the movement mechanism 56', which can use fluid pressure to selectively and controllably move the wand(s) 54. The same fluid source (e.g., the compressor 46 and/or the accumulator 48) can be used to both actuate the movement mechanism 56' (e.g., an air cylinder) and eject fluid from the wand(s) 54 to blow out of the heat exchanger 36. This use of a single air signal for both movement and cleaning helps to simplify the controls and the air system. In further alternative embodiments, the movement mechanism 56' can be fluidically powered from a fluid source other than the compressor 46 and the accumulator 48 (e.g., a hydraulic system).

Figure 1C:
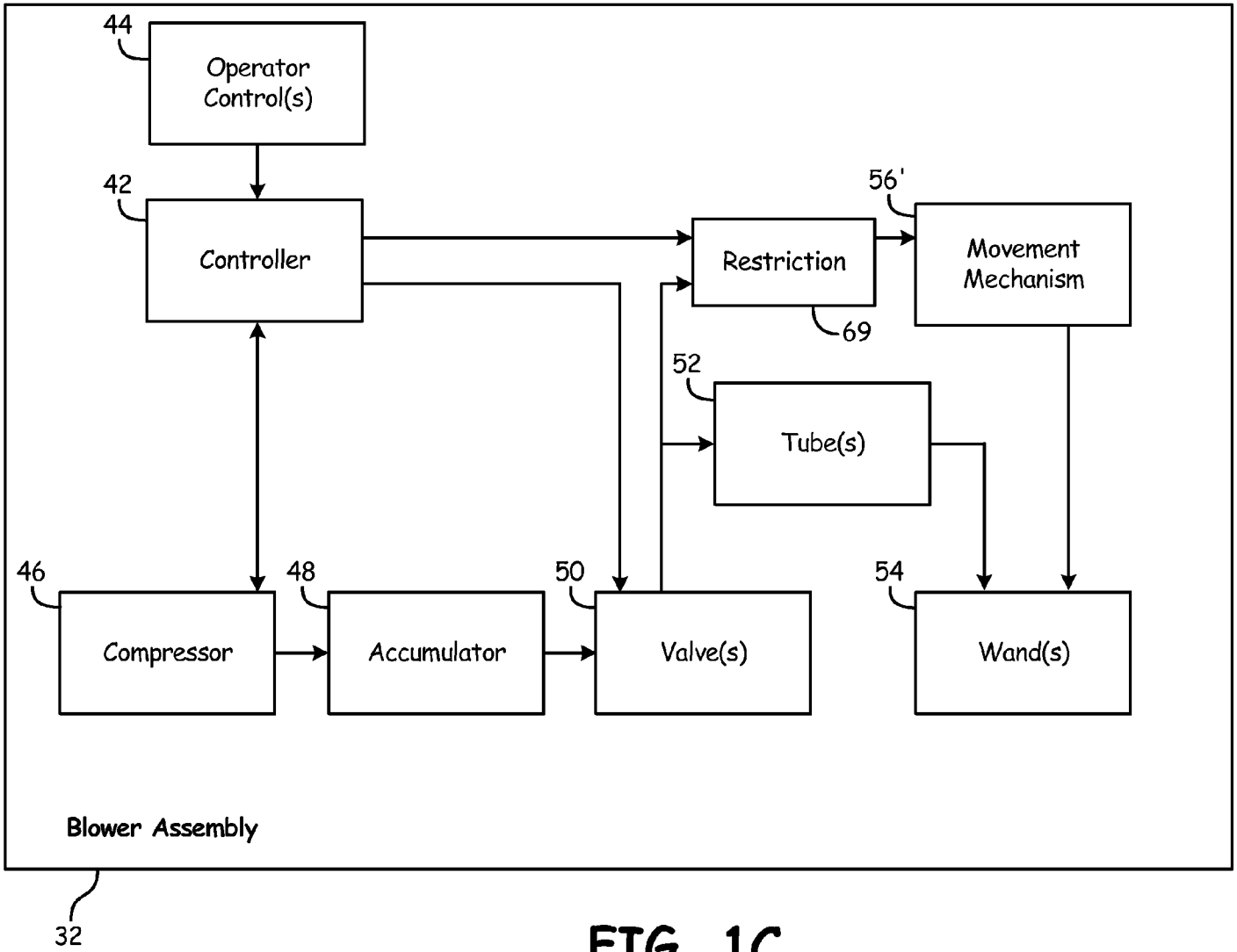
FIG. 1C is a schematic of another alternate embodiment of the heat exchange blower assembly of FIG. 1A.

In an alternative embodiment shown in FIG. 1C, the heat exchanger blower assembly 32 can utilize a fluidically powered (e.g., pneumatic or hydraulic) movement mechanism 56'. As shown in FIG. 1C, fluid from the compressor 46 and the accumulator 48 is directed to both the movement mechanism 56' and the wand(s) 54 by way of the valve(s) 50. The movement mechanism 56' can be a pneumatic or hydraulic cylinder, which can use fluid pressure to selectively and controllably move the wand(s) 54. The same fluid source from the compressor 46 and the accumulator 48 can be used to both actuate the movement mechanism 56' and eject fluid from the wand(s) 54 to blow out of the heat exchanger 36. This use of a single air signal for both movement and cleaning helps to simplify the controls and the air system, and can be provided by making a single fluidic connection to simplify installation. A restriction 69 can optionally be provided, to help allow timing of the assembly 32 to be tuned. The wand(s) 54 will use a significant amount of fluid flow as the fluid is exhausted. By comparison, the movement mechanism 56' requires significantly less fluid flow. In order to keep the motion of the movement mechanism 56' relatively smooth, the restriction 69 can be introduced at or near an inlet of the movement mechanism 56' to throttle the flow of fluid into the movement mechanism 56' and help control the speed at which the movement mechanism 56' operates. For example, if the movement mechanism 56' is an air cylinder with a piston rod, the restriction 69 can help control a speed at which the piston rod extends and thus, a speed of movement (e.g., rotation) of the wand(s) 54. The restriction 69 can be configured as a valve, or alternatively as a fixed orifice nozzle element. If the restriction 69 is configured as a valve, that valve can be actively controlled by the controller 42, other another suitable controller, or can be passive actuated, such as in a configuration in which the valve is pressure regulated without external control. If the restriction 69 is configured as a fixed orifice nozzle element or as a passive valve, then the control line illustrated in FIG. 1C connecting the controller 42 and the restriction 69 can be omitted.

Figure 2:
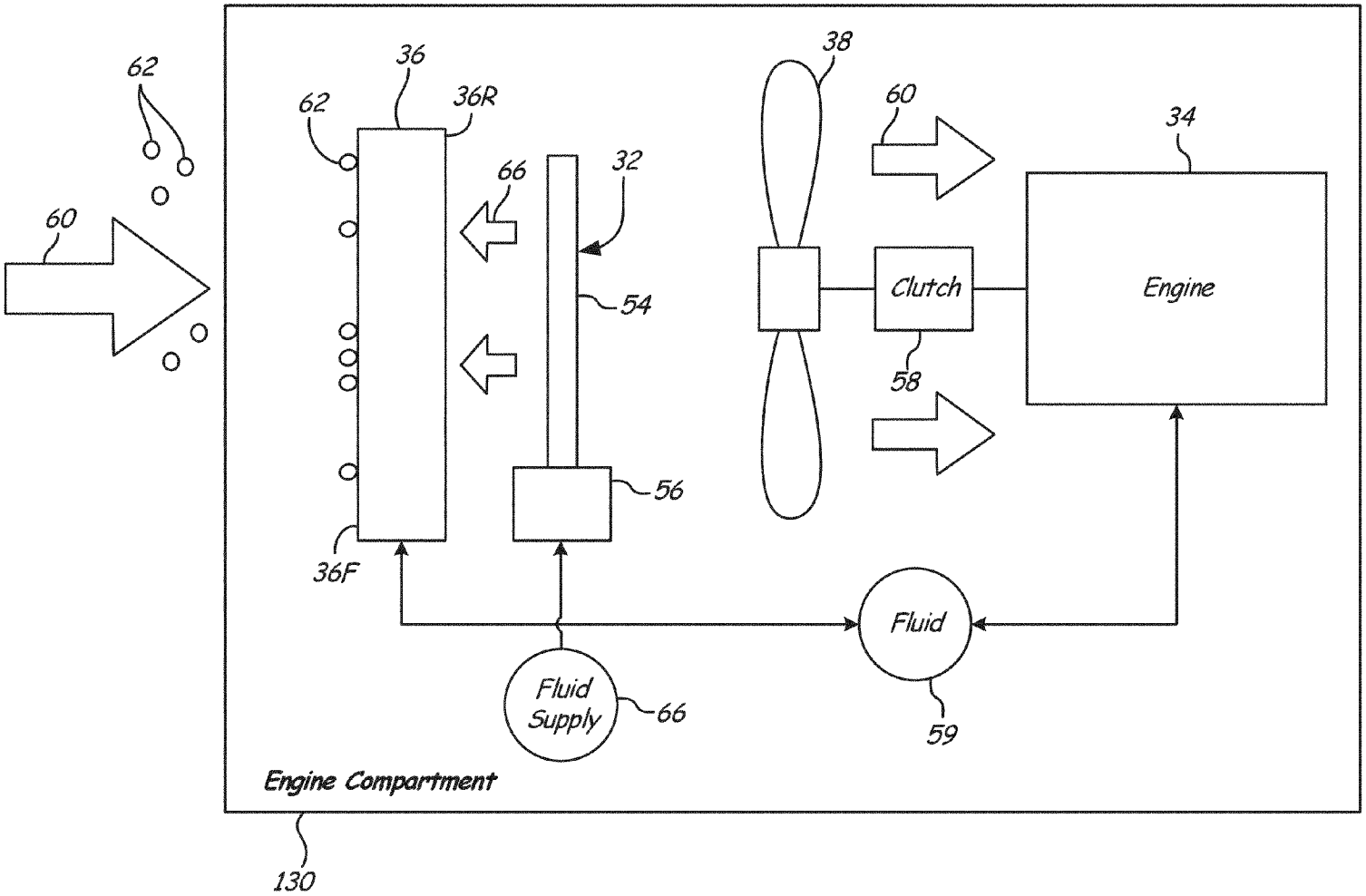
FIG. 2 is a schematic side view of an engine compartment with an embodiment of the heat exchanger blower assembly.

FIG. 2 is a schematic side view of an engine compartment 130 with an embodiment of the heat exchanger blower assembly 32. As shown in FIG. 2, the wand(s) 54 of the blower assembly 32 can be positioned at a rear side 36R of the heat exchanger 36, and located in between the heat exchanger 36 and the fan 38. Debris 62 can collect on a front side 36F of the heat exchanger 36, or within the heat exchanger 36. The front side 36F is located generally opposite the rear side 36R. The fluid 66 can be directed from the wand(s) 54 to the heat exchanger 36 at an desired angle, such as at 90° to the rear side 36R or at smaller angles (e.g., down to 0°)

Figure 3:
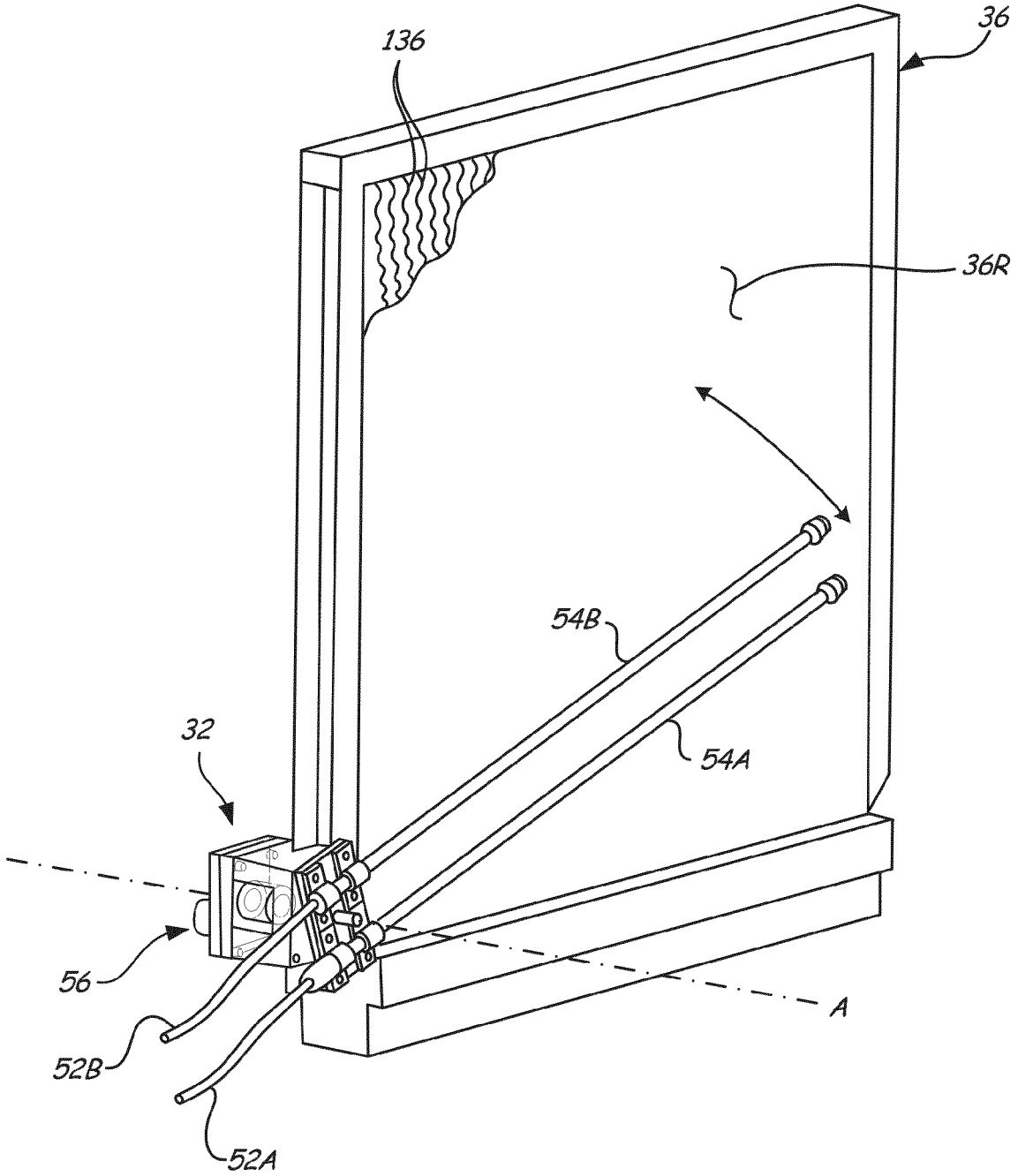
FIG. 3 is a perspective view of a heat exchanger and a portion of the heat exchanger blower assembly of FIG. 2.

FIG. 3 is a perspective view of the heat exchanger 36 and a portion of one embodiment of the heat exchanger blower assembly 32. The heat exchanger 36, as shown in FIG. 3, has a plurality of fins 136 (only a small portion of the fins 136 are shown in FIG. 3, for simplicity) used to increase surface area for thermal energy transfer to ambient air 60. The blower assembly 32 includes the movement mechanism 56 located adjacent to the heat exchanger 36, such as in a mounting location along a periphery of the heat exchanger 36, and at or near a corner (e.g., lower corner) of the heat exchanger 36 in the illustrated embodiment.

The blower assembly 32 includes a first wand 54A and a second wand 54B, each configured with a generally elongate, tubular shape, such as a cylindrical shape. The wands 54A and 54B are positioned in a closely spaced, parallel arrangement in the illustrated embodiment. In further embodiments, the wands 54A and 54B can be positioned at an angle relative to each other, with the angle being relatively small and generally less than 90°. The wands 54A and 54B are commonly supported for pivoting motion about a single pivot axis A. The movement mechanism 56 can selectively produce movement of the wands 54A and 54B, with the tubes 52A and 52B permitting such movement, such as through flexure. The wands 54A and 54B can be configured to pivot approximately 90° about the axis A and back again during operation.

In further embodiments, the blower assembly 32 can be duplicated, or at least additional wands 54 can be provided, such as with wands 54 located at another corner or other peripheral location of the heat exchanger 36 to pivot and sweep across other areas of the heat exchanger 36.

Figure 4:
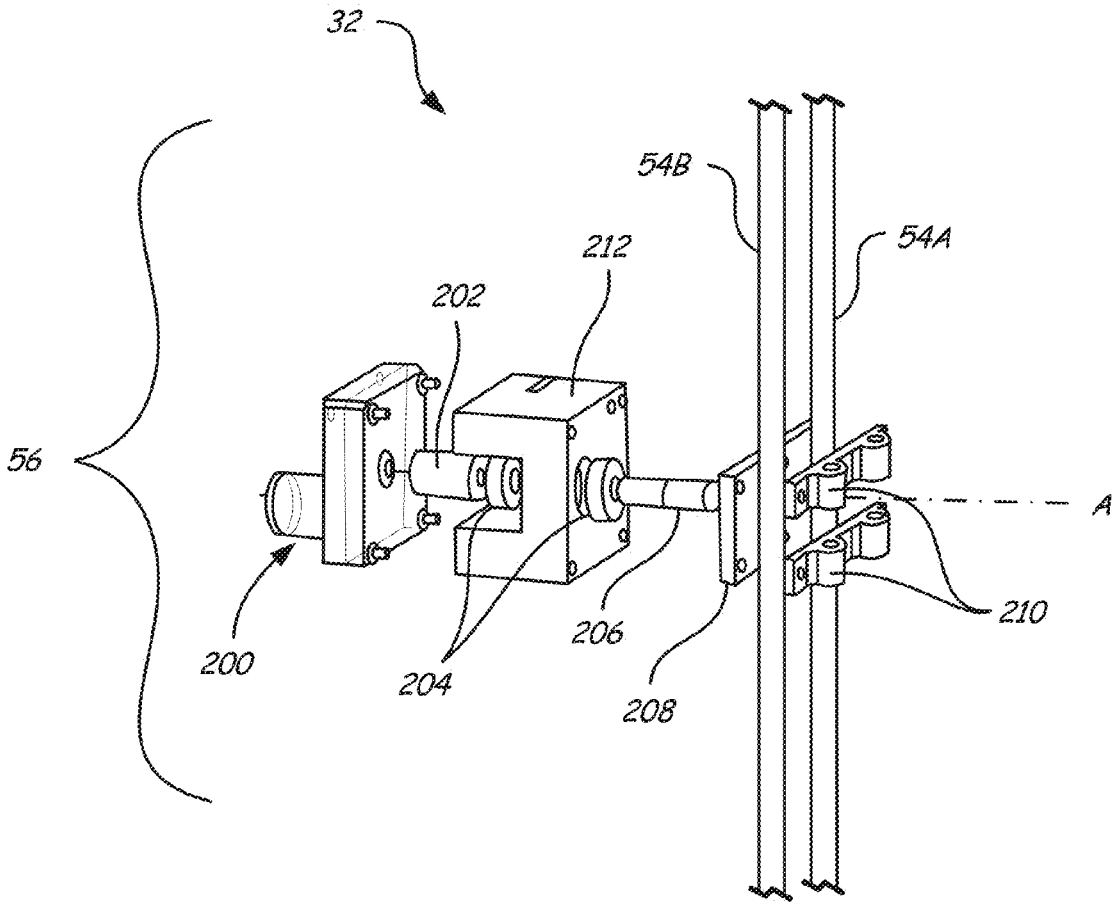
FIG. 4 is an enlarged, exploded perspective view of portions of the heat exchanger blower assembly of FIG. 3.

FIG. 4 is an enlarged, exploded perspective view of portions of the heat exchanger blower assembly 32. The movement mechanism 56, as shown in FIG. 4, includes a motor and gearbox assembly 200, a coupler 202, bearings 204, a drive shaft 206, a mounting plate 208, mounting brackets 210, and mounting block 212. The drive shaft 206 connects the motor and gearbox assembly 200 to the mounting plate 208, and is rotationally supported relative to the mounting block 212 by the bearings 204. The drive shaft 206 can pass through the coupler 202, which can be positioned between the motor and gearbox assembly 200 and the mounting block 212. The wands 54A and 54B can be secured to the mounting plate 208 at or near the axis A with the mounting brackets 210. In one embodiment the wands 54A and 54B are secured at or near one end, such that the wands 54A and 54B extend outward in a cantilevered configuration.

Figure 5:
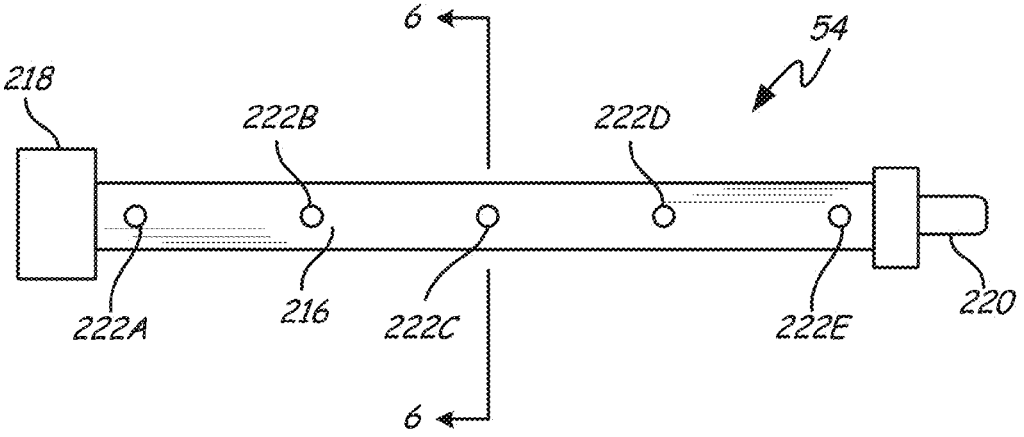
FIG. 5 is a side view of an embodiment of a wand of the heat exchanger blower assembly of FIG. 4.

FIG. 5 is a side view of an embodiment of one of the wands 54, which has a body 216, a cap 218, a fitting 220 and outlet orifices 222A-222E (collectively referred to by reference number 222). As shown, the body 216 is substantially cylindrical, though in other embodiments other shapes can be used. The body can be made of a polymer material, a metal (e.g., aluminum, steel), or other suitable materials. In one embodiment the body 216 can be made of cross-linked polyethylene (PEX) tubing. In one embodiment, the body 216 can be less than or equal to approximately 24 inches (e.g., approximately 23 inches) long with an inner diameter of approximately ¼ inch. The cap 218 can be positioned at a free, distal end of the body 216 to fluidically seal that end. The fitting 220 can be positioned at a proximal end of the body 216, opposite the cap 218, to facilitate connection of the wand 54 to one of the tubes 52A or 52B. There are five circularly-shaped outlet orifices 222A-222E arranged in a linear pattern in the illustrated embodiment, though the number of outlets (e.g., three) and their arrangement (e.g., non-linear) can vary as desired for particular applications. The orifices can be 1/16 inch in diameter, ⅛ inch in diameter, or other sizes. In further embodiments, slot-shaped orifices can be used, such as to produce an air knife. The orifices 222A-222E can be substantially evenly spaced along the body 216, such as at approximately 2½ inch spacing.

Figure 6:
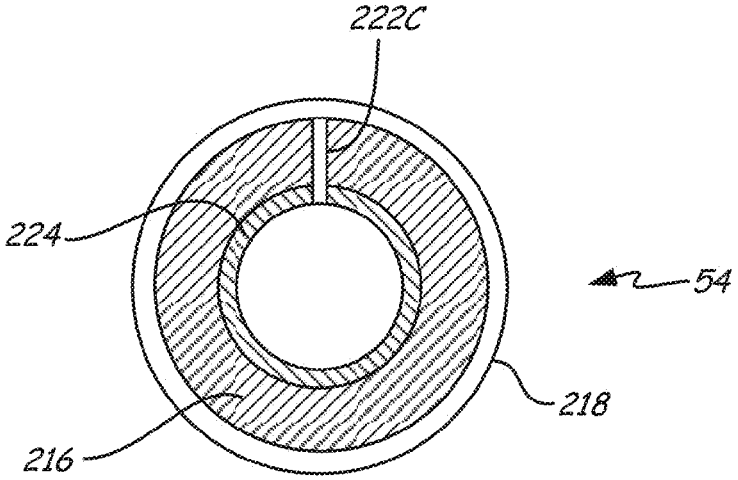
FIG. 6 is a cross-sectional view of the wand, taken along line 6-6 of FIG. 5.

FIG. 6 is a cross-sectional view of the wand 54, taken along line 6-6 of FIG. 5. In the embodiment illustrated in FIG. 6, an optional lining 224 is provided along at least portions of interior flowpath surfaces of the body 216 to modify fluid flow through the wand 54. The lining 224 can be made of a relatively dense wire mesh. In further embodiments the lining 224 can be omitted. Instill further embodiments, additional features can be provided, such as a strake (not shown) on an exterior of the wand 54, to modify airflow, entrain additional airflow and help reduce vortex shedding. Although the wand 54 is shown with a generally circular cross-sectional shape, other shapes are possible, such as elliptical or airfoil shapes.

Figure 7:
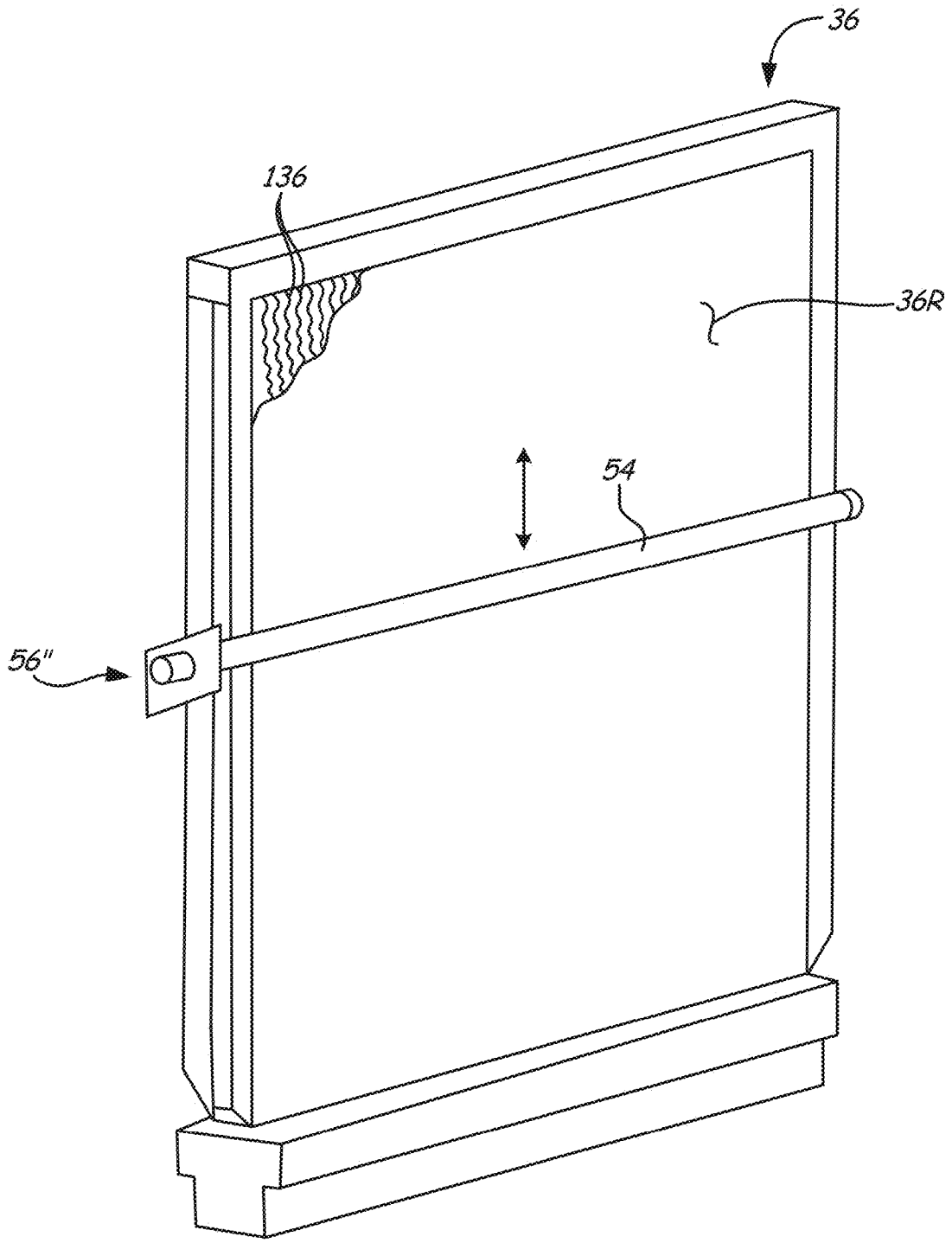
FIG. 7 is a perspective view of the heat exchanger and an alternate embodiment of the heat exchanger blower assembly.

FIG. 7 is a perspective view of an alternative embodiment of the blower assembly 32. As shown in FIG. 7, the wand 54 is configured to translate (rather than pivot) relative to the rear face 36R of the heat exchanger 36. A movement mechanism 56" can be configured to provide a translational movement, such as through rack-and-pinion gears, a worm drive, cable and winch, or other suitable mechanism. The wand 54 can optionally be connected to the heat exchanger 36 with tracks or guides at one or both ends. Although in FIG. 7 the wand 54 is shown with an orientation to travel upwards and downwards, in further embodiments a side-to-side, diagonal or other direction of movement can be utilized.

During operation, for any embodiment of the blower assembly 32, pressurized fluid 66 can be provided to the wand(s) 54 and ejected from the orifices 222 toward the heat exchanger 36 while the wand(s) 54 are pivoted, translate or otherwise moved across a face of the heat exchanger 36 by the movement mechanism 56. In some embodiments, the blower assembly 32 can be selectively or periodically activated, such as only when the heat exchanger 36 becomes fouled or clogged below a given threshold. The fluid 66 can be cycled in relatively short bursts or "blasts" (e.g., approximately 1-2 second bursts) by the valve(s) 50. In embodiments in which multiple wands 54 are used, the valves 50 can cycle the fluid 66 to the wands 54 individually, such that the fluid 66 is ejected from the wands 54 at the same time or at different times. Control of the blower assembly 32 can optionally be coordinated with operation of the fan 38 and/or the clutch 58. For instance, the clutch 58 could turn off the fan 38 or reduce a speed of rotation of the fan 38 during at least a portion of the time during which the blower assembly 32 operates, such that competition between flows of the fluid 66 and the air 60 in opposite directions is reduced. Once a given movement cycle of the blower assembly 32 is complete, the clutch 58 can re-start rotation of the fan 38 and to provide further cooling flows of the air 60. Control of the fan 38 can be accomplished by sending appropriate signals to govern the torque output of the clutch 58, which generally governs the torque input to the fan 38.

Figure 8:
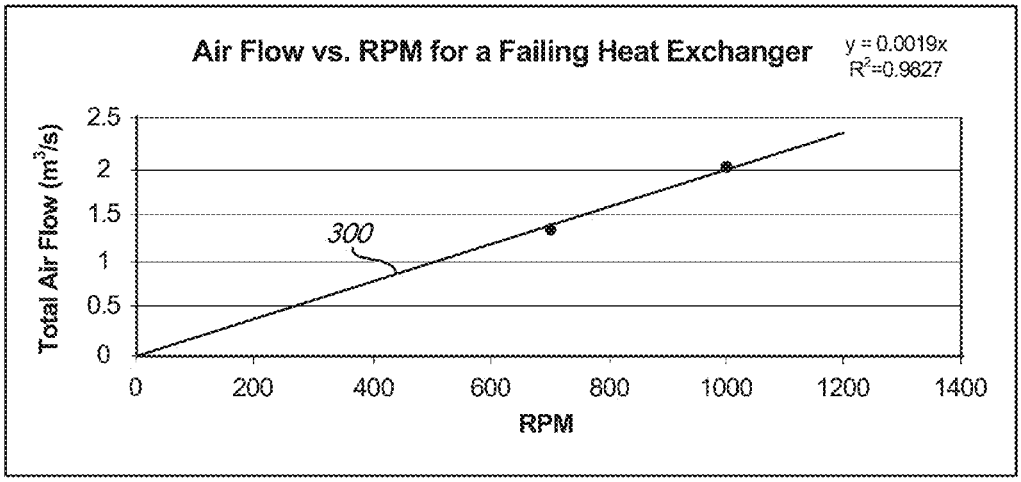
FIG. 8 is a graph illustrating an example fouling boundary, shown as a function of fan RPM, according to the present invention.

In one embodiment, a fouling boundary threshold can be established, such that when the heat exchanger becomes fouled at or beyond the threshold, the blower assembly 32 is activated (automatically or manually). Airflow sensors 43 (optional) can be used to sense airflow conditions, and provide that information to the controller 42. FIG. 8 is a graph illustrating an example fouling boundary 300, shown as a function of fan revolutions per minute (RPM). The graph in FIG. 8 plots total air flow Q (in cubic meters per second) vs. RPM of the fan 38. It has been discovered that fouling of the heat exchanger 36 can be assessed on the basis of a substantially linear threshold 300, representing approximately 25% blockage or approximately 6.8% or greater reduction in flow rate through the heat exchanger 36 as compared to a clean exchanger 36. As shown in FIG. 8, the threshold 300 crosses the origin, with Q=1.31 at 700 RPM and Q=1.98 at 1000 RPM. The blower assembly 32 can be activated whenever airflow is at or below the threshold 300. Establishing a relatively low fouling boundary threshold can allow cleaning to be performed relatively frequently with the fluid 66 ejected toward the heat exchanger 36 at relatively low pressures, whereby providing suitable cleaning while reducing a risk of damage (e.g., bending) to the fins 136.

Figure 9:
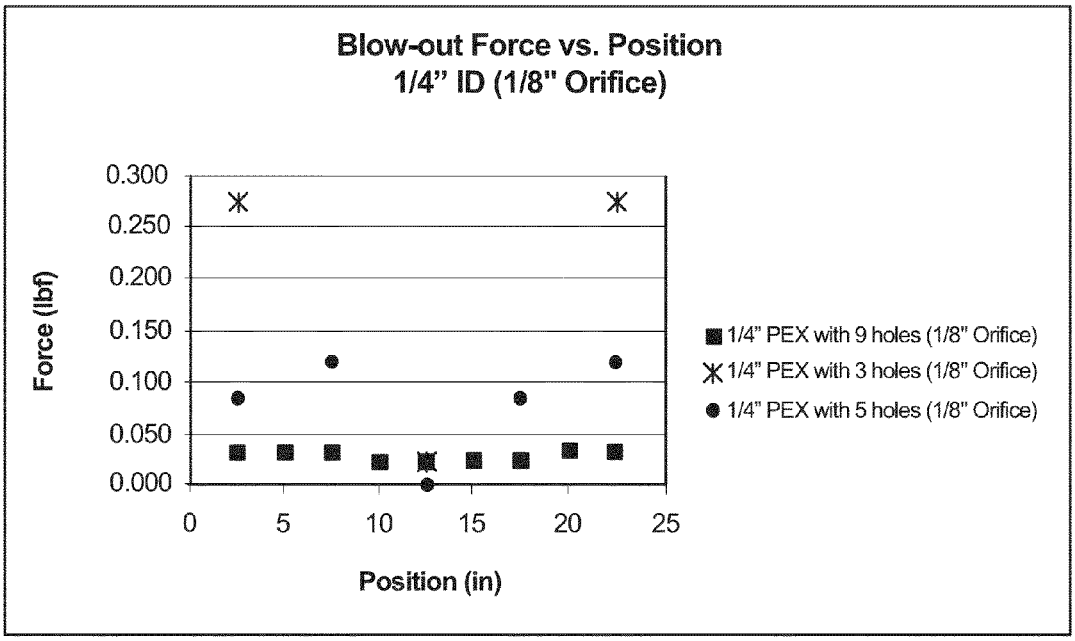
FIGS. 9 and 10 are graphs illustrating blow-out force of fluid for different embodiments of a heat exchanger blower assembly of the present invention.
Figure 10:
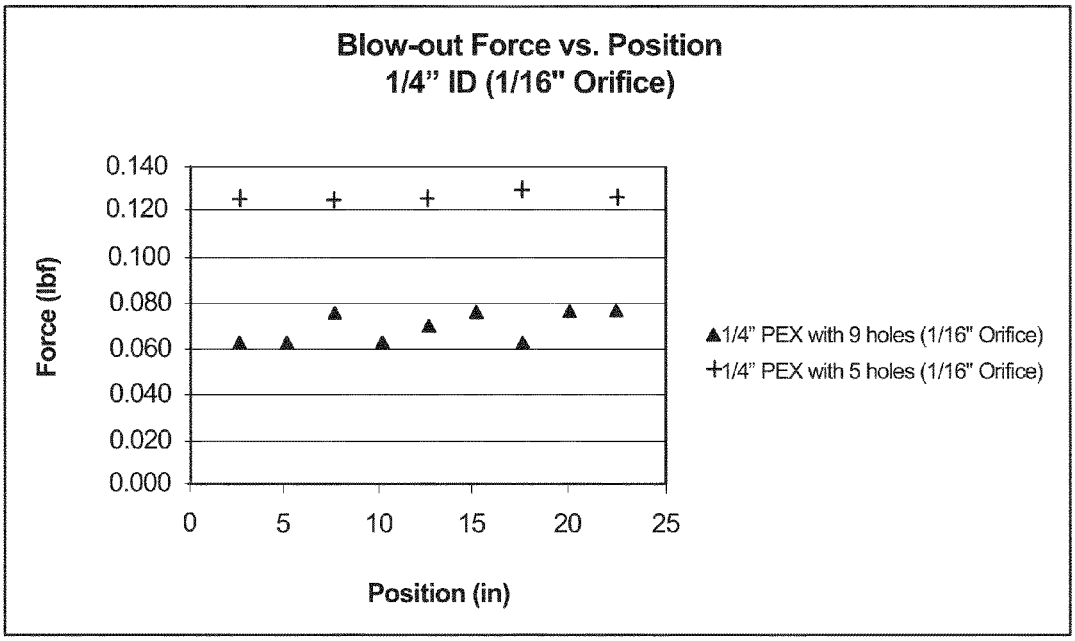

FIGS. 9 and 10 are graphs illustrating blow-out force of the fluid 66 for different embodiments of the heat exchanger blower assembly 32, plotted as force (lbf) vs. position in niches from the proximate end of the wand 54. FIG. 9 illustrates force exerted by the fluid 66 at the outlet orifices 222 for a wand 54 with ¼ inch (0.25 inch) inner diameter for three, five and nine orifices 222 of ⅛ inch (0.125 inch) diameter each, with the fluid supplied from the accumulator 48 at approximately 110 psi. FIG. 10 illustrates force exerted by the fluid 66 at the outlet orifices 222 for a wand 54 with ¼ inch inner diameter for five and nine orifices 222 of 1/16 inch (0.0625 inch) diameter each, with the fluid supplied from the accumulator 48 at approximately 110 psi. A pressure range of 40-120 psi for fluid 66 supplied by the accumulator 48 can be used. Because operation of the blower assembly 32 tends to reduce available pressure in the accumulator 48, a threshold of 10 psi, or alternatively 5-7 psi, can be established for a maximum allowable pressure drop in the accumulator 48. Using a plurality of relatively short blasts of the blower assembly 32 of no more than a few seconds can allow suitable pressure to be maintained in the accumulator 48.

In one embodiment, providing the fluid 66 at 40 psi is suitable for clearing the heat exchanger 36 at approximately 25% fouling, 60 psi for clearing the heat exchanger 36 at approximately 50% fouling, and 120 psi for clearing the heat exchanger 36 at approximately 100% fouling. Initiating cleaning at relatively low pressures at no more than 25% fouling may maintain adequate levels of cleanliness to avoid the need for blasts of the fluid 66 at higher pressures that may risk damage to the fins 136. For the embodiment shown in FIG. 10 with 1/16 inch diameter orifices 222, the average force of the jets of the fluid 66 were 0.126 lbf with a 0.001 lbf standard deviation. In further embodiments, the fluid 66 can be ejected from each of the orifices 22 with at least 0.25 lbf or 0.29 lbf+/−0.03 lbf. In still further embodiments, the fluid 66 can be ejected from each of the orifices 22 with 1.6+/−0.5 lbf. Pressure of jets of the fluid 66 can vary at each of the orifices 222, and pressure can be provided to the wand 54 as a function of pressure at any one or more of the total number of orifices 222. In various embodiments, pressure of the supplied fluid 66 can be at any desired pressure (e.g., 0.025 to 0.300 lbf, subsets of that range of forces, or other ranges whether overlapping or not), though it has been discovered that high pressures present a risk of damage to the heat exchanger by bending the fins 136.

It is also possible to characterize fluid flow in terms of velocity of the jets of the fluid 6 leaving the orifices 222. In one embodiment, velocity of the fluid 66 can be in the range of approximately 564 to 1867 ft/s. Velocity can vary for each of the orifices 222, and other velocity values and ranges are possible in further embodiments.

Figure 11:
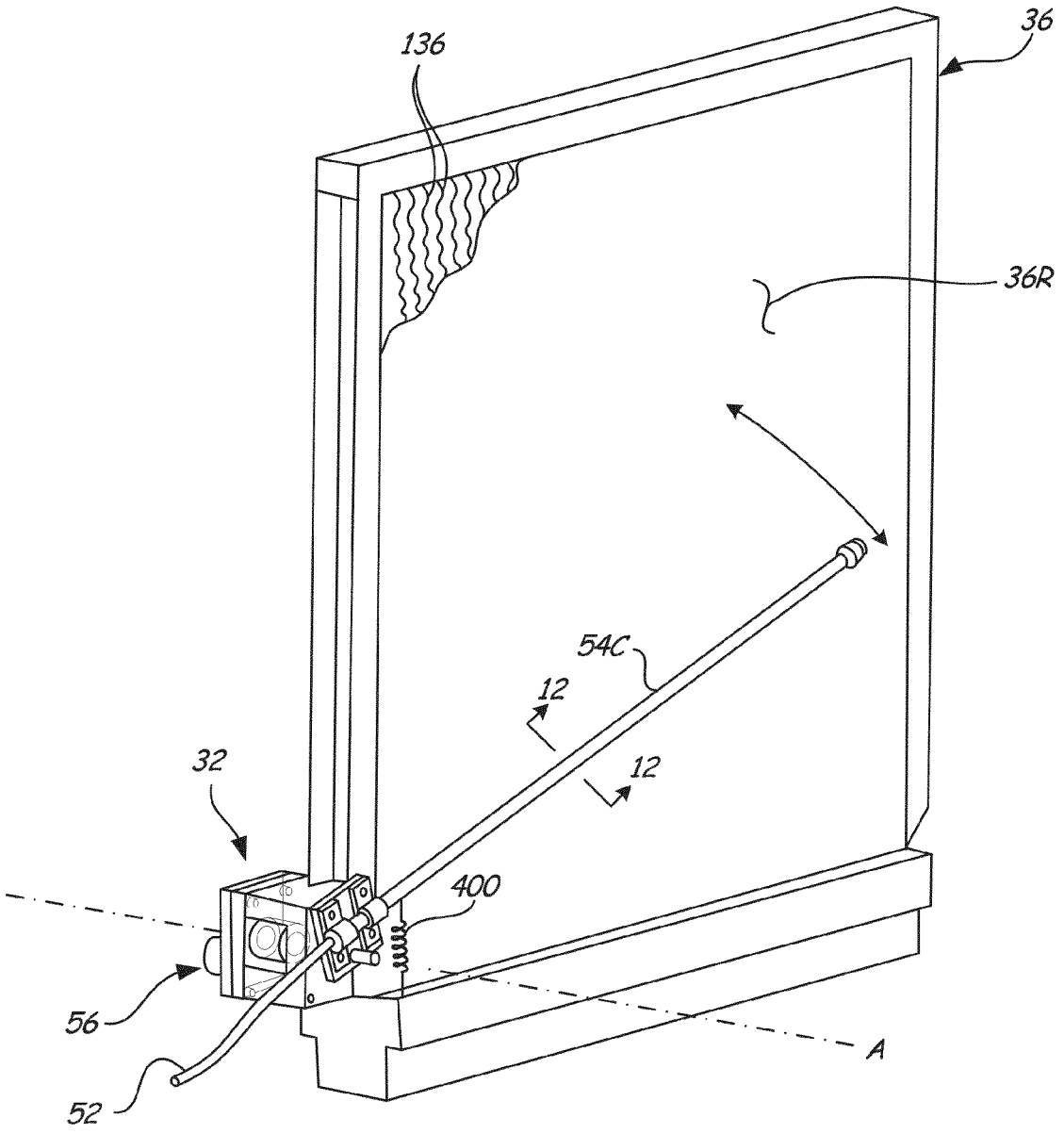
FIG. 11 is a perspective view of a heat exchanger and yet another embodiment of a blower assembly according to the present invention.
Figure 12:
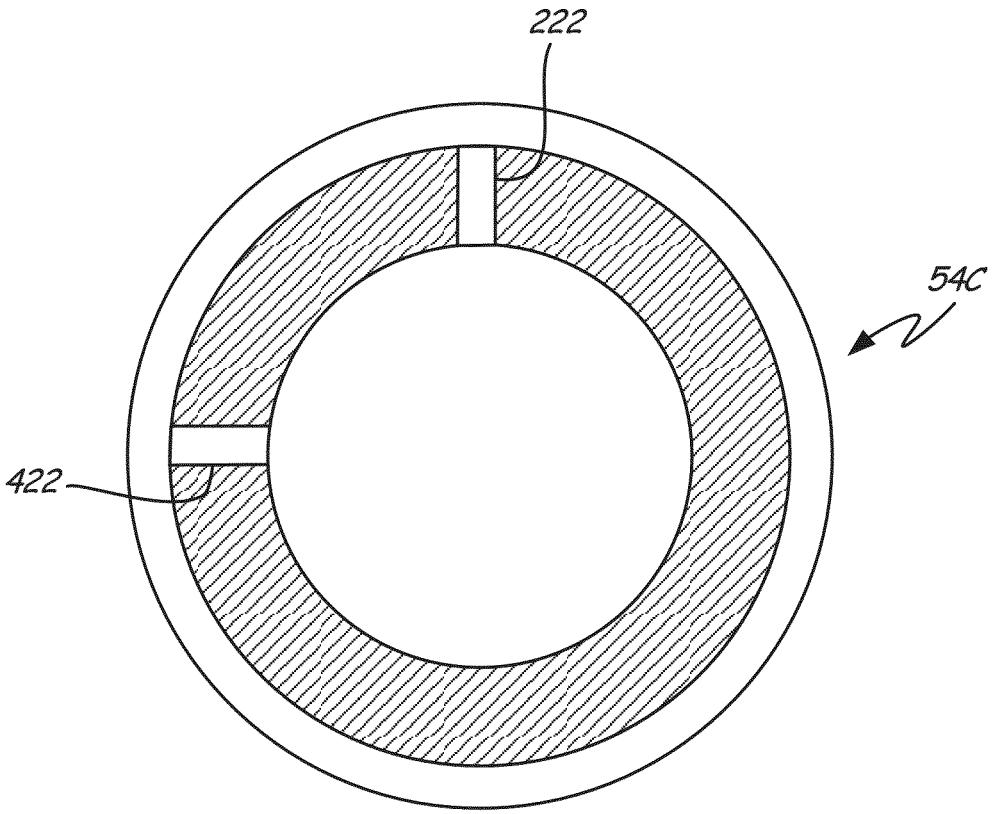
FIG. 12 is a cross-sectional view of a wand, taken along line 12-12 of FIG. 11.

In still further embodiments, a blower assembly 32 can include one or more thrusters to move a wand 54C. FIG. 11 is a perspective view of the heat exchanger 36 and an embodiment of the blower assembly 32, and FIG. 12 is a cross-sectional view of the wand 54C, taken along line 12-12 of FIG. 11. As shown in FIGS. 11 and 12, a spring 400 is attached to the wand 54C to urge or bias the wand 54C toward a resting position. As shown in FIG. 12, the wand includes one or more additional thruster orifices 422 that can eject the fluid 66 from the wand 54C to generate a motive force to help propel the wand 54C across the rear face 36R of the heat exchanger 36 during operation. When fluid flow ceases, such as through actuation of the valve(s) 50, the spring 400 can bias the wand 54C back to a resting position. The thruster orifices 422 and the spring 400 can be oriented to provide forces in generally opposite directions. In the illustrated embodiment, a movement mechanism 54 is also provided to cooperate and act in concert with the thruster orifices 422 to selectively produce movement of the wand 54C, but the movement mechanism 54 can be omitted in alternate embodiments. The thruster orifices 422 can have a different orientation than the orifices 22 that direct a cleaning jet at the heat exchanger 36, such as at approximately 90° to the orifices 222. In further embodiments, other orientations of the thruster orifices 422 are possible, which will generally depend on the orientation of the orifices 222, though maximum thrust will generally be obtained when the thruster orifices 422 are positioned at approximately 0° relative to the rear face 36R. The thruster orifices 422 can be located at desired locations along the wand 54C, between proximal and distal ends of the wand 54C. Optimal locations can be selected as a function of available fluid pressure and mechanical advantage obtained by distance from the axis A.

Although only one thruster orifice 422 is shown in FIG. 12, any suitable number of orifices 422 can be provided as desired. For instance, a row of orifices 422 can be provided in a line much like the orifices 222A-222E shown in FIG. 5. Furthermore, although FIG. 11 illustrates a pivotal wand, a translating wand can also be provided in alternate embodiments that would function in essentially the same manner. Additionally, the thruster orifices 422 can have suitable shapes to provide desired thrust or flow characteristics, such as having a converging-diverging shape.

In still further embodiments, a separate channel can be provided in the wand 54C for fluid supplied to the thruster orifices 422, such that fluid for the orifices 222 and the thruster orifices 422 are separated. Such a configuration can allow controlled delivery of thrust with the thruster orifices 422, for instance, controlled through one or more of the valve(s) 50.

Figure 13:
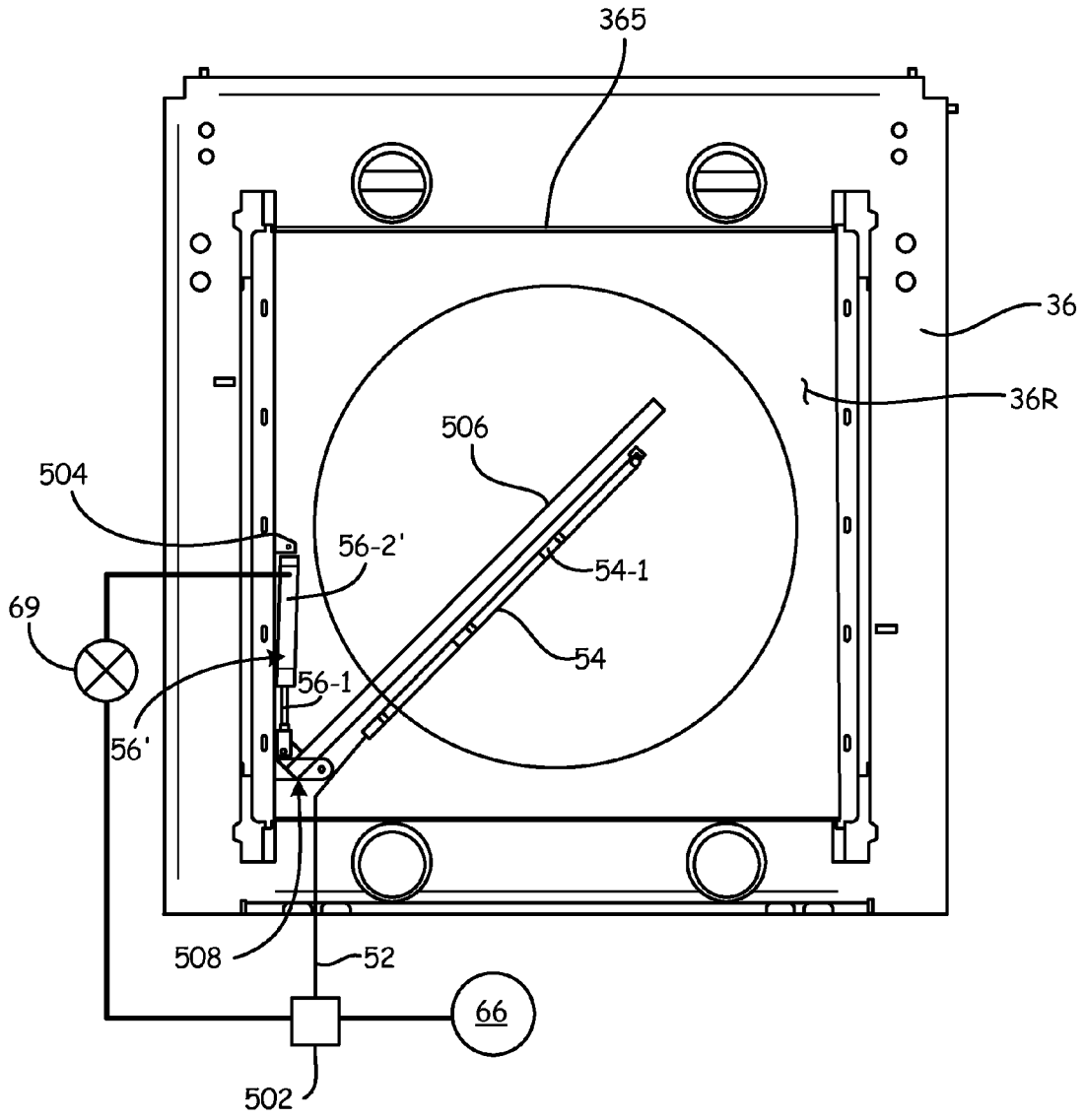
FIG. 13 is an elevation view of the heat exchanger and yet another embodiment of a blower assembly according to the present invention.
Figure 14C:
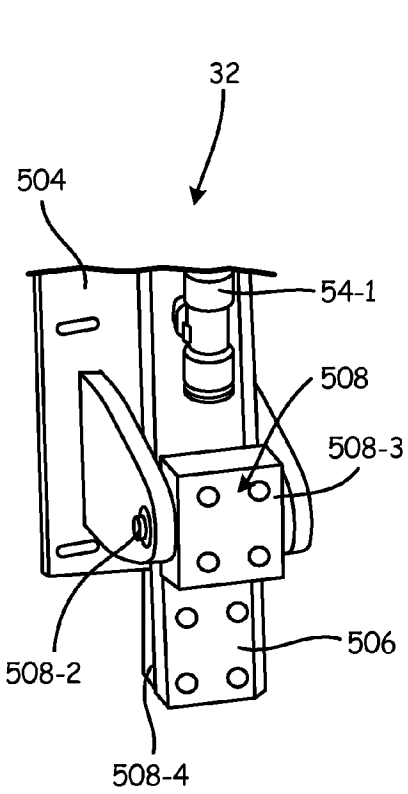
FIGS. 14B and 14C are enlarged perspective views of portions of the blower assembly of FIGS. 13 and 14A.
Figure 14B:
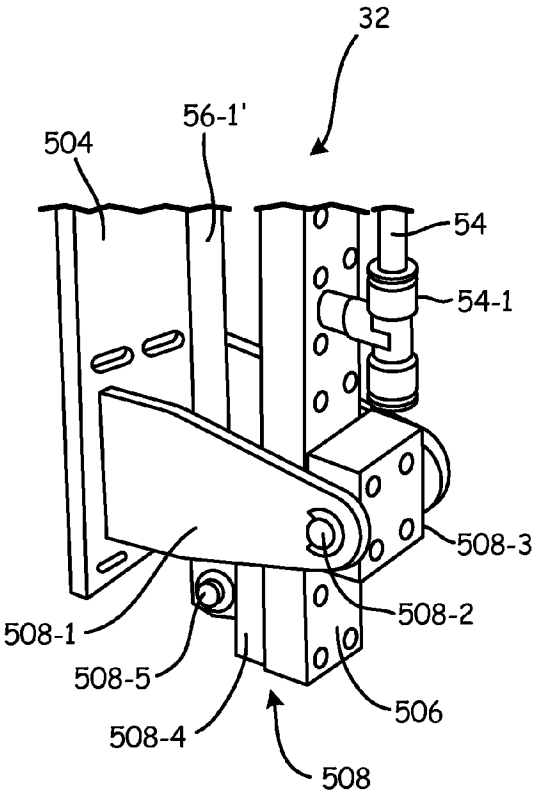
Figure 14A:
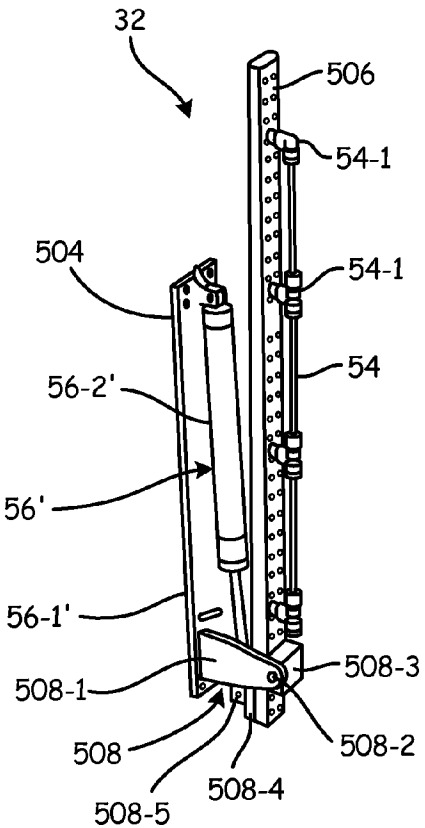
FIG. 14A is a perspective view of the blower assembly of FIG. 13.

FIG. 13 is an elevation view of a heat exchanger 36 and yet another embodiment of a blower assembly 32. Additional perspective views of the blower assembly 32 of FIG. 13 are shown in FIGS. 14A-14C. Certain components of the blower assembly 32 are omitted in FIGS. 14A-14C for simplicity, such as tube (e.g., a flexible hose) 52 for making a fluidic connection between components. In the illustrated embodiment, the blower assembly 32 includes at least one tube or conduit 52, one or more wands 54 (only one wand 54 is present in the illustrated embodiment), a movement mechanism 56' configured as an air cylinder, a restriction 69 configured as a valve, a manifold 502, a mounting member 504, a support arm 506, and a pivot assembly 508.

The wand 54 can be configured in accordance with any of the previously described embodiments, for instance. Attachment supports 54-1 can be provided to secure the wand 54 to the support arm 506. During operation, the wand 54 can sweep across the heat exchanger 36 and discharge the fluid 66 to provide cleaning.

The movement mechanism 56' in the illustrated embodiment is configured as an air cylinder having a piston rod 56-1' and a cylinder body 56-2'. A spring (not shown) can be engaged between the piston rod 56-1' and the cylinder body 56-2' to provide a biasing force such that the piston rod 56-1' is retracts, at least partially, into the cylinder 56-2' in the absence of fluid pressurization. Fluid pressurization, which can be actively controlled via the restriction valve 69, causes the piston rod 56-1' to extend relative to the cylinder body 56-2'. The cylinder body 56-2' can be secured (e.g., with a pivoting connection) to the support member 504, and the piston rod 56-1' can be secured to the support arm 506 by the pivot assembly 508, or vice-versa.

The manifold 502 can be a tee or other suitable device that splits or otherwise divides an input from the a source of fluid 66 into multiple outputs, with one output fluidically connected to the restriction valve 69 and the movement mechanism air cylinder 59' and another output fluidically connected to the wand(s) 54 by the tube(s) 52. Although not illustrated in FIGS. 13-14C, the manifold 502 can accept the fluid 66 from the valve(s) 50 illustrated in FIG. 1C, or other components, as desired for particular embodiments.

The mounting member 504 can be configured as a plate or an elongate bar, and provides a structure base for attachment of the blower assembly 32 to the heat exchanger 36 or another suitable structure (e.g., a vehicle frame). As shown in FIG. 13, the mounting member 504 is arranged substantially vertically along a rear face 36R of the heat exchanger 36, inside a shroud 36S of the heat exchanger 36, though in further embodiments other mounting orientations and locations can be utilized. In some embodiments, all or most of the components of the blower assembly can be structurally supported by the mounting member 504, allowing the entire assembly to be secured when the mounting member 504 is secured to the desired mounting location. In this way, the blower assembly 32 can be modular, and aside from new installations can also be relatively easily retro-fitted to an existing heat exchanger 36.

The support arm 506 can be any suitable elongate bar, beam or rod that provides structural support to the wand 54 and can move with the wand 54. In alternate embodiments, the support arm 506 can be integrated into the wand 54 as a single monolithic part, or can be omitted entirely if the wand 54 is sufficiently rigid and strong.

The pivot assembly 508 in the illustrated embodiment includes a yoke 508-1, a first axle 508-2, blocks 508-3 and 508-4, and second axle 508-5. The yoke 508-1 can be mounted to, or alternatively integrally and monolithically formed with, the mounting member 504. The block 508-3 is secured to the support arm 506, and the first axle 508-2 can rotationally couple the block 508-3 and the yoke 508-1. The block 508-3 can be a separate element attached to the support arm 506 with suitable fasteners, or alternatively can be integrally and monolithically formed with the support arm 506. In still further embodiments, the block 508-3 can be omitted and the first axle 508-2 directly coupled to the support arm 506. The block 508-4 is secured to the support arm 506 and the second axle 508-5 rotationally couples the block 508-4 to the piston rod 56-1' of the movement mechanism air cylinder 59'. A bushing or bearing can optionally be provided at the coupling to either or both of the axles 508-2 and/or 508-5. In the illustrated embodiment, the first and second axles 508-2 and 508-5 are offset, such that movement of the piston rod 56-1' causes the support member 506 and the wand 54 to pivot relative to the mounting member 504 (e.g., about the first axle 508-2).

In the illustrated embodiment of FIGS. 13-14C, a normal resting position for the wand 54 would be in a horizontal position. When a fluid signal is provided to the blower assembly 32, the fluid would begin to flow from the wand 54 against the heat exchanger 36, which would help to blow out any debris that is trapped in the fins of the heat exchanger 36. Fluid pressure would also be simultaneously and concurrently introduced to the cylinder body 56-2' causing the piston rod 56-1' to extend and actuate the wand 54 through an arc across the rear face 36R of the heat exchanger 36. When the cycle is complete, the fluid source is turned off and the spring in the cylinder body 56-2' exhausts the fluid causing the wand 54 to rotate back to the horizontal resting position. The return to the resting position can be gravity-assisted, and/or encouraged with an optional biasing member (e.g., like the spring 400) or simply by the spring within the cylinder body 59-2'.

The wand 54 can have any suitable length to accommodate a variety of heat exchanger dimensions, and the diameter and orifice sizes can vary likewise vary as desired for particular applications. The movement mechanism air cylinder 59' and the location of the pivot points (i.e., the first and second axles 508-2 and 508-5) can also vary depending on the size and shape of the installation. The blower assembly 32 can be placed in any corner of the heat exchanger 36. Furthermore, there can be multiple cleaning wands 54 in the same assembly in further embodiments. For example, there could be one wand 54 or one blower assembly 32 in each corner of the heat exchanger 36. Alternatively, multiple wands 54 can be arranged to move together, such as with substantially parallel wands 54 commonly supplied with pressurized fluid and moved by the same movement mechanism air cylinder 59'.

Any relative terms or terms of degree used herein, such as "substantially", "essentially", "generally" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, intermittent pressure variations, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims. For example, features described with respect to any given embodiment can be utilized in conjunction with any other disclosed embodiment. Also, the present invention can be implemented in conjunction with other structures or steps not specifically discussed, as would be understood by a person of ordinary skill in the art.

The invention claimed is:

1. A method for cleaning a heat exchanger having a plurality of fins, the method comprising:

directing a pressurized fluid to a wand;

directing the pressurized fluid to a movement mechanism, wherein the movement mechanism utilizes pressurization of the pressurized fluid to produce torque;

rotating the wand across at least a portion of a face of the heat exchanger using torque from the movement mechanism;

ejecting the pressurized fluid from a plurality of orifices in the wand toward the heat exchanger; and biasing the wand to a default position, wherein the biasing is provided in a direction that opposes a direction of the torque produced by the movement mechanism by way of the pressurization of the pressurized fluid.

2. The method of claim 1 and further comprising:
limiting a force of the pressurized fluid ejected from each of the plurality of orifices to be below a threshold at which the fins of the heat exchanger are susceptible to damage.

3. The method of claim 1 and further comprising:
securing a mounting member to the heat exchanger inside a shroud of the heat exchanger, wherein the wand and the movement mechanism are both supported by the mounting member.

4. The method of claim 1, wherein the wand has a substantially horizontal orientation when the movement mechanism is substantially unpressurized by the pressurized fluid.

5. The method of claim 1 and further comprising:
turning on a torque input to a fan after the pressurized fluid has ceased being ejected from the plurality of orifices in the wand, wherein the fan moves airflow in a direction substantially opposite to the direction in which the pressurized fluid is ejected from at least one of the orifices in the wand.

6. The method of claim 1 and further comprising:
turning off a torque input to a fan associated with the heat exchanger during at least a portion of a time when the pressurized fluid is ejected from the plurality of orifices in the wand.

7. A method for cleaning a heat exchanger having a plurality of fins, the method comprising:
dividing flow of a pressurized fluid between a wand and a movement mechanism;
directing a first portion of the pressurized fluid to the wand;
directing a second portion of the pressurized fluid to the movement mechanism, wherein the movement mechanism utilizes pressurization of the second portion of the pressurized fluid to produce torque;
rotating the wand across at least a portion of a face of the heat exchanger using torque from the movement mechanism;
ejecting the first portion of the pressurized fluid from one or more orifices in the wand toward the heat exchanger; and
restricting flow of the second portion of the pressurized fluid to the movement mechanism relative to flow of the first portion of the pressurized fluid to the wand.

8. The method of claim 7 and further comprising:
limiting a force of the first portion of the pressurized fluid ejected from each of the one or more orifices to be below a threshold at which the fins of the heat exchanger are susceptible to damage.

9. The method of claim 7 and further comprising:
securing a mounting member to the heat exchanger inside a shroud of the heat exchanger, wherein the wand and the movement mechanism are both supported by the mounting member.

10. The method of claim 7, wherein the wand rotates through an at least partially vertically oriented plane and has a substantially horizontal orientation in a resting position.

11. The method of claim 10 and further comprising:
maintaining the wand in the resting position, wherein the movement mechanism is substantially unpressurized by the second portion of the pressurized fluid when the wand is maintained in the resting position.

12. The method of claim 11, wherein the wand is substantially unpressurized by the first portion of the pressurized fluid when maintained in the resting position.

13. The method of claim 7 and further comprising:
biasing the wand to a resting position, wherein the biasing is provided in a direction that opposes a direction of the torque produced by the movement mechanism by way of the pressurization of the second portion of the pressurized fluid.

14. The method of claim 13, wherein the wand is biased by way of a spring internal to the movement mechanism.

15. The method of claim 7 and further comprising:
turning off a torque input to a fan during at least a portion of a time when the pressurized fluid is ejected from the one or more orifices in the wand.

16. The method of claim 15 and further comprising:
turning on the torque input to the fan after the first portion of the pressurized fluid has ceased being ejected from the one or more orifices in the wand, wherein the fan moves airflow in a direction substantially opposite to the direction in which the pressurized fluid is ejected from at least one of the one or more orifices in the wand.

17. A method for cleaning a heat exchanger having a plurality of fins, the method comprising:
securing a mounting member to the heat exchanger inside a shroud of the heat exchanger;
connecting a wand and a movement mechanism to a fluid pressurization source, wherein the wand and the movement mechanism are both supported by the mounting member;
directing a pressurized fluid to the wand;
directing the pressurized fluid to the movement mechanism, wherein the movement mechanism utilizes pressurization of the pressurized fluid to produce torque;
rotating the wand across at least a portion of a face of the heat exchanger using torque from the movement mechanism;
biasing the wand to a resting position at or near a perimeter of the heat exchanger, wherein the biasing is provided in a direction that opposes a direction of the torque produced by the movement mechanism by way of the pressurization of the pressurized fluid; and
ejecting the pressurized fluid from an orifice in the wand toward the heat exchanger.

18. The method of claim 17, wherein the steps of directing the pressurized fluid to the movement mechanism and rotating the wand across at least a portion of a face of the heat exchanger using torque from the movement mechanism are performed using a single fluid signal.

19. The method of claim 17, wherein the step of connecting the wand and the movement mechanism to the fluid pressurization source comprises making a single fluid connection.

20. The method of claim 17 and further comprising:
dividing flow of the pressurized fluid between the wand and the movement mechanism.

21. The method of claim 20 and further comprising:
restricting flow of the pressurized fluid to the movement mechanism relative to flow of the pressurized fluid to the wand.

22. The method of claim 17, wherein the wand rotates through an at least partially vertically oriented plane and has a substantially horizontal orientation in a resting position.

23. The method of claim 22 and further comprising:
maintaining the wand in the resting position, wherein the movement mechanism is substantially unpressurized by the pressurized fluid when the wand is maintained in the resting position.

24. The method of claim 23, wherein the wand is substantially unpressurized by the pressurized fluid when maintained in the resting position.

25. The method of claim 17 and further comprising:

biasing the wand to a resting position, wherein the biasing is provided in a direction that opposes a direction of the torque produced by the movement mechanism by way of the pressurization of the pressurized fluid.

26. The method of claim 25, wherein the wand is biased by way of a spring internal to the movement mechanism.

27. The method of claim 17 and further comprising:

turning on a torque input to a fan after the first portion of the pressurized fluid has ceased being ejected from the plurality of orifices in the wand, wherein the fan moves airflow in a direction substantially opposite to the direction in which the pressurized fluid is ejected from at least one of the orifices in the wand.

28. The method of claim 27 and further comprising:

turning off the torque input to the fan during at least a portion of a time when the pressurized fluid is ejected from the one or more orifices in the wand.

* * * * *